US007523933B2

(12) United States Patent
Linder et al.

(10) Patent No.: US 7,523,933 B2
(45) Date of Patent: Apr. 28, 2009

(54) ADJUSTABLE FORCE DRIVING NIP ASSEMBLIES FOR SHEET HANDLING SYSTEMS

(75) Inventors: Michael J. Linder, Walworth, NY (US); Wayne C. Powley, Ontario, NY (US); Matthew R. McLaughlin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 208 days.

(21) Appl. No.: 11/505,604

(22) Filed: Aug. 17, 2006

(65) Prior Publication Data

US 2008/0042340 A1 Feb. 21, 2008

(51) Int. Cl.
*B65H 5/02* (2006.01)
*B65H 5/04* (2006.01)

(52) U.S. Cl. ..... 271/274; 271/272; 271/273; 271/275; 271/314; 700/126; 700/213

(58) Field of Classification Search ..... 271/272, 271/273, 274, 275, 314; 700/213, 126
See application file for complete search history.

(56) References Cited

U.S. PATENT DOCUMENTS 4,762,314 A * 8/1988 Harada ..... 271/267
4,951,062 A * 8/1990 Page et al. ..... 346/134
5,344,058 A * 9/1994 Baffo ..... 226/181
5,406,362 A * 4/1995 Mills ..... 399/126
5,435,540 A * 7/1995 Martin et al. ..... 271/122
5,594,486 A * 1/1997 Kiyohara ..... 347/104
5,678,159 A 10/1997 Williams et al.
5,715,514 A 2/1998 Williams et al.
6,173,952 B1 * 1/2001 Richards et al. ..... 271/228
6,494,451 B2 * 12/2002 Michel ..... 271/274
2004/0251607 A1 12/2004 Mandel et al.
2004/0251618 A1 * 12/2004 Niizeki ..... 271/272
2005/0133991 A1 * 6/2005 Ata et al. ..... 271/273
2005/0184455 A1 * 8/2005 Youn ..... 271/274
2005/0280206 A1 * 12/2005 Ahn et al. ..... 271/273
2007/0018387 A1 * 1/2007 Yamamoto ..... 271/272
2007/0029725 A1 * 2/2007 Marx et al. ..... 271/272
2007/0035085 A1 * 2/2007 Abe et al. ..... 271/272
2007/0069456 A1 * 3/2007 Jeong ..... 271/272

* cited by examiner

*Primary Examiner*—Patrick H Mackey
*Assistant Examiner*—Prasad V Gokhale
(74) *Attorney, Agent, or Firm*—Luis M. Ortiz; Kermit D. Lopez; Ortiz & Lopez, PLLC

(57) ABSTRACT

An adjustable force driving nip assembly for use in a sheet transport system of a document creating apparatus has a plurality of adjustable force driving nips aligned and spaced transversely across the sheet travelling path of the sheet transport system. Each driving nip has a spring biased idler roller mounted on a cam follower and mated with a driven roller. The spring bias produces a normal force for the idler roller that urges the idler roller against the driven roller. A stepper motor is adapted to interact concurrently with the cam followers and, upon actuation, vary the force of the spring thus adjusting the normal force of the idler rollers. A controller actuates the stepper motor in response to sheet media data entered into a control panel of the document creating apparatus by an end user, thereby automatically adjusting the normal force of the idler rollers to prevent sheet marking.

18 Claims, 6 Drawing Sheets

FIG. 3
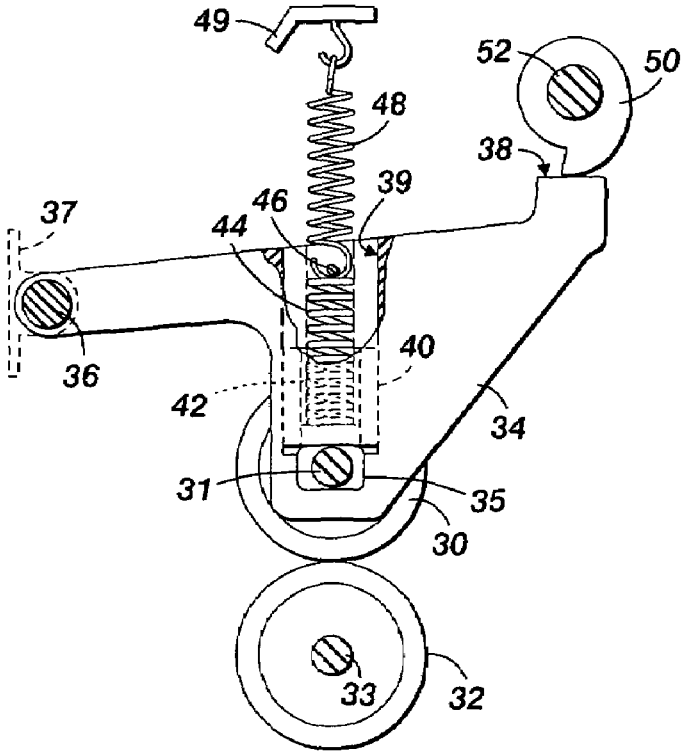
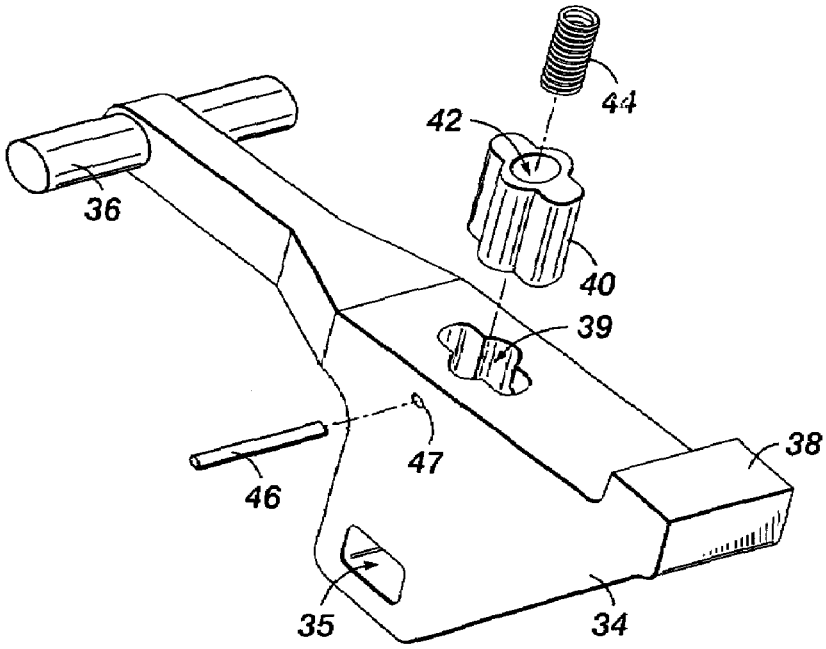
FIG. 4

FIG. 7
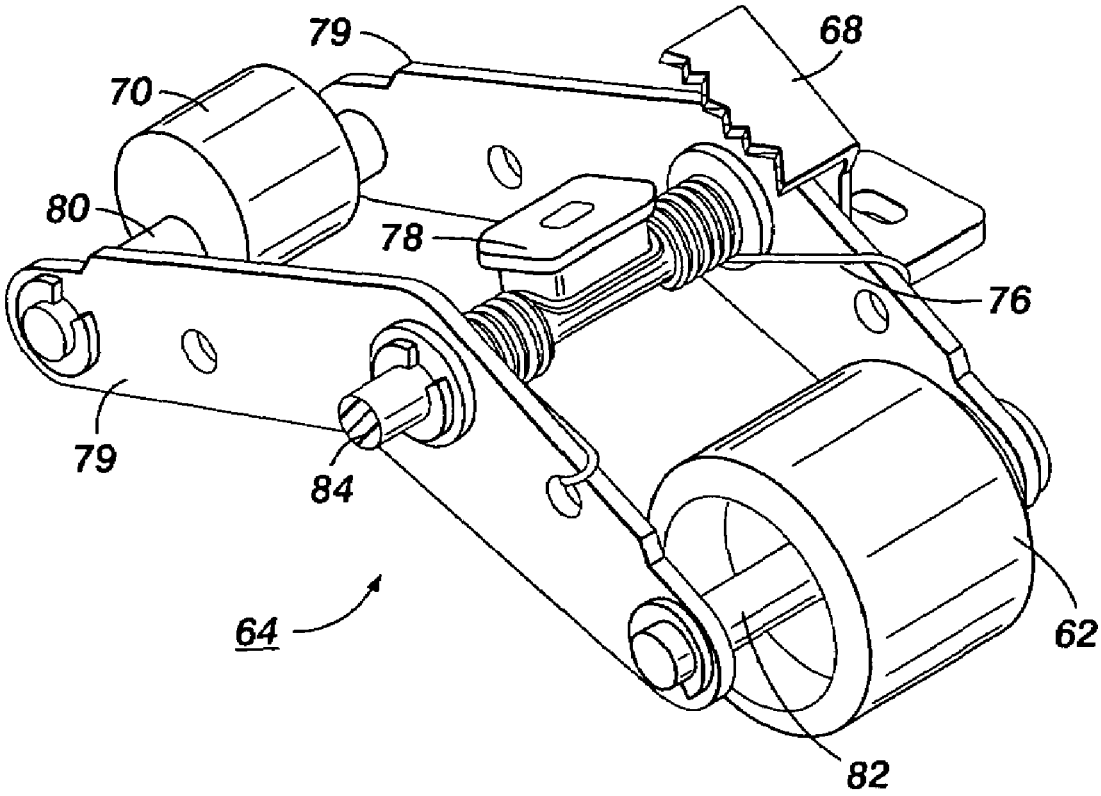
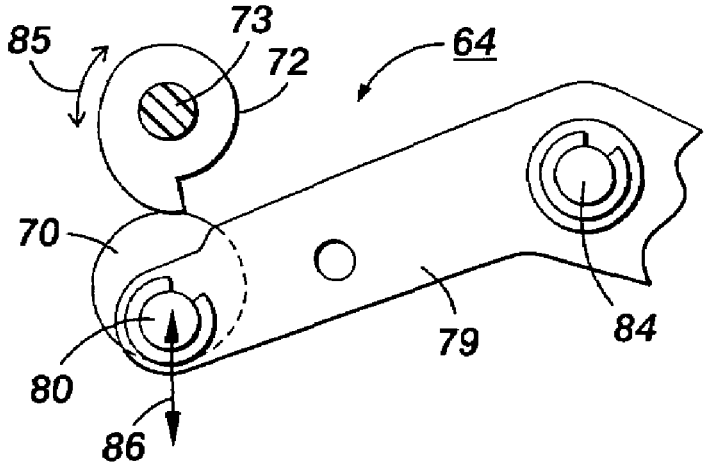
FIG. 8

ADJUSTABLE FORCE DRIVING NIP ASSEMBLIES FOR SHEET HANDLING SYSTEMS

BACKGROUND

An exemplary embodiment of this application relates to an adjustable force driving nip assembly for use in a sheet handling system of, for example, a document creating apparatus. More particularly, the exemplary embodiment relates to an adjustable force driving nip assembly located in the registration areas of the sheet transport path of a document creating apparatus, such as a copier or printer. Each driving nip assembly has a plurality of individual adjustable force driving nips that are spaced transversely across the sheet transport path. Each individual driving nip has a spring-biased idler roller mounted on a pivoting cam follower with the idler roller being mated with a driven roller to form the driving nip. The normal force generated by the spring bias of the idler roller and applied to a sheet passing between the nips formed by the idler rollers and the driven rollers may be automatically adjusted in response to sheet media parameters an end user inputs into the control panel of the document creating apparatus.

In document creating apparatus, such as, for example, xerographic copiers and printers, it is increasingly important to be able to provide faster yet more accurate and reliable handling of a wide variety of image bearing sheets. Typically, the sheets are paper or plastic transparencies of various sizes, weights, and surfaces and may be subject to varying environmental conditions, such as humidity. Elimination of sheet skewing or other sheet misregistration is very important for proper imaging. In addition, sheet misregistration or misfeeding can adversely affect sheet feeding, ejection, as well as stacking and finishing of the sheets. While many document creating apparatus have adequate deskewing and side registration systems, as delineated in the prior art listed below, none have the ability to prevent sheet marking automatically for a wide range of sheet media.

Sheet transporting devices are known to have driving nips that are typically designed to provide a normal force on the paper being transported therethrough that is sufficient to provide drive forces for sheets with particular media parameters without marking the sheet. However, as substrate or sheet mass increases, the potential for slip increases as well. Normal forces in the driving nip can be increased to offset this, but the potential for marking the lighter weight paper also increases. Thus, it is the aim of the exemplary embodiment of this application to provide automatic adjustment of the normal force of the driving nips to accommodate the transport of a wide variety of sheet media used by the document creating apparatus without marking the sheets being transported.

U.S. Pat. Nos. 5,678,159 and 5,715,514 disclose dual differentially driven nips for automatic deskewing and side registration of sheets to be imaged in a printer, including the appropriate controls of the differentially driven sheet steering nips and including cooperative arrayed sheet edge position detector sensors and signal generators. As described therein, by driving two spaced apart steering nips with a speed differential to partially rotate a sheet for a brief period of time concurrently as the sheet is being driven forward by both nips, the sheet is briefly driven forward at an angle. Then the relative difference in the nip drive velocities is reversed to side shift the sheet into a desired lateral registration position as well as correcting any skew of the sheet as it entered the steering nips. Thus, the sheet exits the steering nips aligned in the process direction as well as being side registered.

U.S. Pat. No. 6,173,952 discloses a sheet handling system for correcting the skew and/or transverse position of sequential sheets moving in a process direction in a sheet transport path of a reproducing apparatus to be registered for image printing. The deskewing and/or side registration is accomplished by partially rotating the sheet with a transversely spaced pair of differentially driven sheet steering nips. The range of sheet size capabilities of this system may be increased without steering nip slippage or other problems by applying a control signal proportional to the width of the sheet to the system for automatically increasing or decreasing the transverse spacing between the pair of sheet steering nips. This is accomplished by automatically engaging only a selected pair of steering nips out of a plurality of different fixed position sheet steering nips and disengaging the others by lifting their idlers out of the sheet path with cams rotated by a stepper motor. The rotation of the cams by the stepper motor is controlled by the sheet width signal.

U.S. Patent Publication No. 20040251607 published Dec. 16, 2004 discloses a system for automatically releasing selected plural sheet feeding nip sets spaced along a sheet feeding path of a printer. Each nip has an idler roller and a driven roller. The idler rollers are rotatably mounted on common idler shafts. A selectable rotation system driven by a single low cost motor is connected to the plural idler shafts to partially rotate eccentric cams on each idler shaft to lift the idler shafts and thereby move the idler rollers away from their mating driven rollers to release all sheet feeding nips.

SUMMARY

According to aspects illustrated herein, there is provided an adjustable force driving nip assembly for use in a sheet transport system of a document creating apparatus. The adjustable force driving nip assembly has a plurality of individually adjustable force driving nips aligned and spaced transversely across the sheet travelling path of the sheet transport system in the registration areas of the document creating apparatus. Each driving nip has a spring biased idler roller mounted on a cam follower with the idler roller being mated against a driven roller. The driven rollers are mounted on a common drive shaft. The cam followers are pivotally mounted, so that the normal force generated by the spring bias and applied to a sheet passing through the driving nips may be adjusted by cams mounted on a common cam shaft. Rotation of the cam shaft by a motor in response to the sheet media parameters entered into a control panel in the document creating apparatus by an end user automatically adjusts the normal force of the idler roller.

In one aspect of the exemplary embodiment, there is provided an adjustable force driving nip assembly for use in a sheet handling system of a document creating apparatus having a control panel for data entry by an end user, comprising: a plurality of individual driving nips aligned and spaced transversely across a sheet transport path of said sheet handling system, each driving nip of said driving nip assembly having a spring biased idler roller mounted on a cam follower and mated against a driven roller; said driven rollers of said driving nip assembly being mounted on a common drive shaft, said drive shaft being driven by an electric motor; said cam followers being pivotally mounted, so that a normal force generated by said spring biased idler rollers is applied to a sheet passing through said driving nips; a cam for each cam follower being mounted on a common rotatable cam shaft and each cam being in contact with one of said cam followers, whereby rotation of said cam shaft pivots said cam followers to adjust said normal force of said idler rollers; and a stepper motor for rotating said cam shaft in response to sheet media data entered into said control panel by an end user for automatically adjusting said normal force of said idler rollers.

In another aspect of the exemplary embodiment, there is provided an adjustable force driving nip assembly for use in a sheet handling system of a document creating apparatus having a control panel for sheet media data entry by an end user, comprising: a plurality of individual driving nips aligned and spaced transversely across a sheet transport path of said sheet handling system, each driving nip of said driving nip assembly having a torsion spring biased idler roller mounted on a respective cam follower and mated against a respective driven roller, said driven rollers of said driving nip assembly being mounted on a common drive shaft, said drive shaft being driven by an electric motor; each of said cam followers in said driving nip assembly being pivotally mounted on a common pivot shaft, said pivot shaft having a torsion spring anchor for each cam follower; each of said torsion springs being centrally held by said respective torsion spring anchor and having a predetermined number of spring wraps around said pivot shaft on each side of said torsion spring anchor, each of said torsion springs having opposing ends connected to said cam follower, so that a normal force generated by said torsion spring biased idler rollers is applied to a sheet passing through said driving nips; a stepper motor for rotating said common pivot shaft in response to sheet media data entered into said control panel by an end user, whereby said stepper motor automatically adjusts said normal force of said idler roller by increasing or decreasing the number of wraps of said torsion spring about said pivot shaft; and a cam for each cam follower being mounted on a common rotatable cam shaft, each cam being in contact with one of said cam followers, whereby rotation of said cam shaft pivots said cam followers causes said idler rollers to engage or disengage from said driven rollers and may also provide for some adjustment of said normal force of said idler rollers.

BRIEF DESCRIPTION OF THE DRAWINGS

An exemplary embodiment of this application will now be described, by way of example, with reference to the accompanying drawings, in which like reference numerals refer to like elements, and in which:

FIG. 3 is a partially sectioned view of the adjustable force driving nip assembly as viewed along line 3-3 shown in FIG. 2 with maximum normal force being applied by the idler roller to the driven roller of the nip assembly;

FIG. 4 is an exploded view of one of the pair of cam followers that holds each idler roller as shown in FIG. 2;

FIG. 7 is an isometric view of the cam follower and spring biased idler roller of the embodiment shown in FIG. 6; and FIG. 8 is a partially shown side view of the cam in contact with the cam follower shown in FIG. 7.

DESCRIPTION OF THE PREFERRED EMBODIMENT

Figure 1:
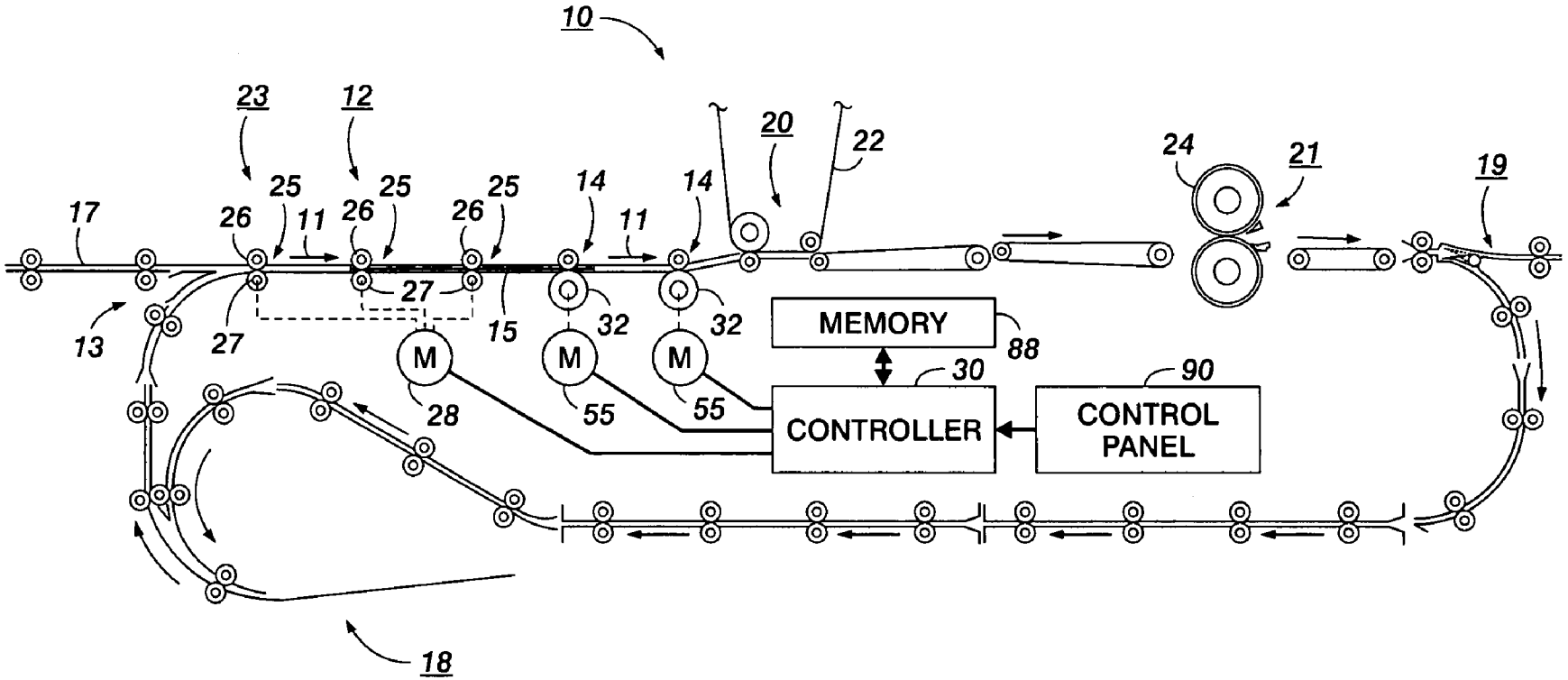
FIG. 1 is a schematic side view of a sheet handling system of a document creating apparatus incorporating the adjustable force driving nip assemblies of this application.

In FIG. 1, there is shown a schematic side elevation view of the sheet handling system 12 of a document creating apparatus 10, comprising, by way of example, a high speed xerographic printer that incorporates the adjustable force driving nip assembly 14 of this application. In the document creating apparatus or printer 10, sheets 15 to be printed are conventionally fed through an overall sheet or paper path by the sheet handling system 12. Clean sheets to be printed are fed into a sheet input 17, which has a converging or merged path entrance 13 from a duplex sheet return path 18. Sheets inputted from either sheet input 17 or duplex sheet return path 18 are fed downstream in the direction of arrow 11 through a deskewing section 23 of the overall sheet handling system 12, an image transfer station 20, an image fusing station 21, and sheet output 19. When duplex copies are to be developed, the sheet with an image on only one side is directed to the duplex sheet return path 18 instead of the sheet output 19 in order to receive a backside image. At the transfer station 20, developed images on the photoreceptor 22 are transferred to the sheets 15 as they pass therethrough by a process well known in the reproduction industry. The images on the sheets 15 are permanently fixed to the sheets at the fusing station 21 by any suitable fusing system, such as a pair of fuser rolls 24, that is also well known in the printer industry.

In the illustrated apparatus 10 of FIG. 1, the sheet 15 is deskewed and side registered in accordance with a suitable deskewing and registering system 23, such as that described in U.S. Pat. No. 6,173,952 and incorporated herein by reference in its entirety. The deskewing and registering system 23 comprises three identical plural nip units 25 respectively spaced along the sheet path of the sheet handling system 12 in the sheet feeding or process direction, indicated by arrow 11, by distances therebetween capable of positively feeding the smallest desired sheet 15. The sheet 15 is moved from one nip unit 25 to the other and then to the adjustable force driving nip assemblies 14 of this application, two of which are shown in FIG. 1. Each of the identical nip units 25 in the deskewing and registering system 23 has a plurality of idler rollers 26 and associated driven rollers 27 spaced transversely across the process direction. Each of the idler rollers 26 and associated driven rollers 27 form a driving nip that may be used to deskew and register the sheets 15. A stepper motor (not shown), under the control of controller 30, operates the idler rollers 26 in a manner as disclosed in U.S. Pat. No. 6,173,952. The driven rollers 27 are rotated by motor 28 that is also under the control of controller 30.

Figure 2:
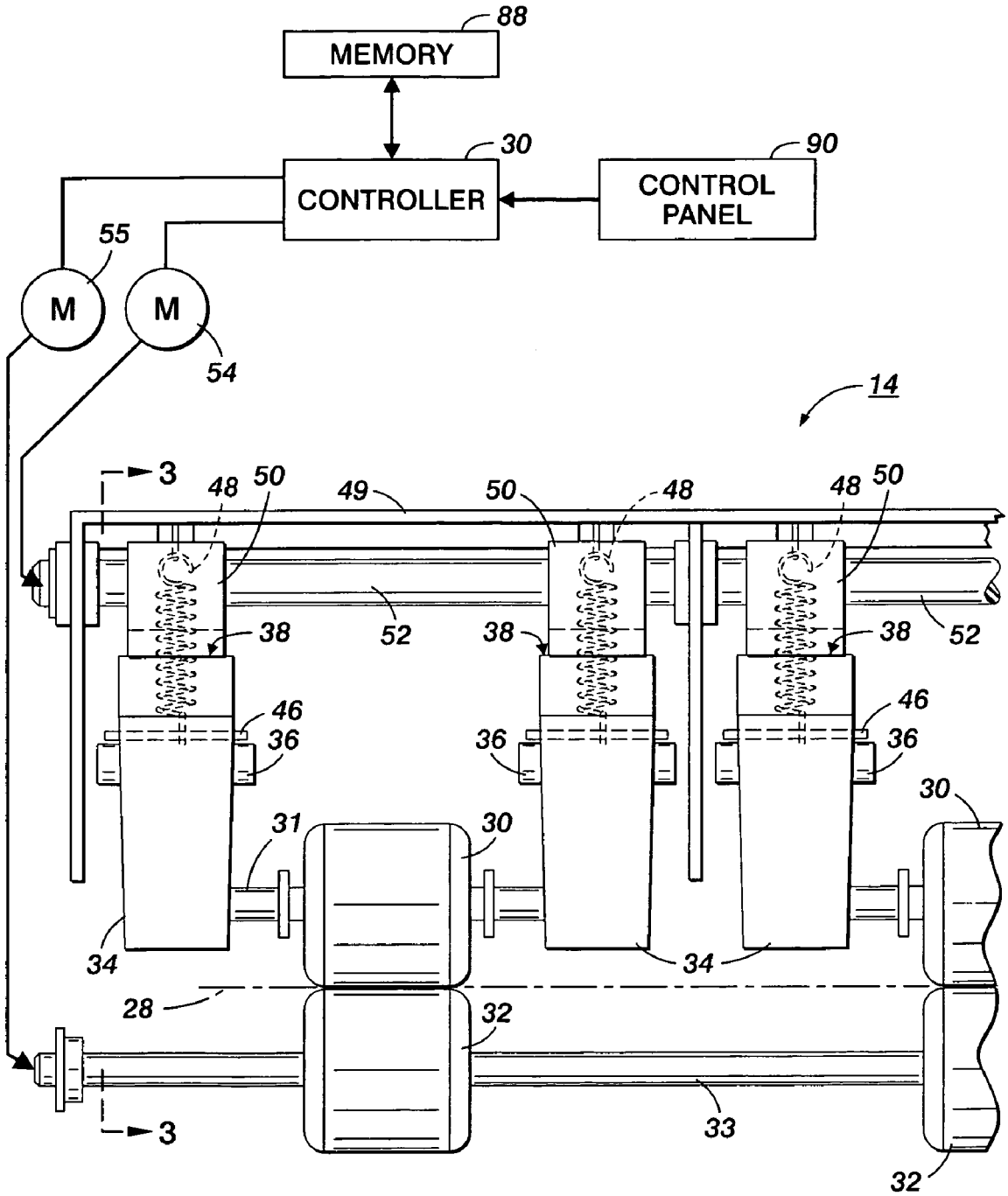
FIG. 2 is a partially shown view of an adjustable force driving nip assembly as viewed in a direction perpendicular to the transport path of a sheet travelling along the sheet handling system.

Referring to FIG. 2, a partially shown view of an adjustable force driving nip assembly 14 is depicted as viewed in a direction that is transverse to the sheet feeding or process direction (see arrow 11 in FIG, 1). Each adjustable force driving nip assembly 14 contains at least three idler rollers 30, each of which are rotatably mounted on its own shaft 31. The idler rollers are spaced across the sheet transport path and mated with a respective driven roller 32 to form a driving nip. The driven rollers 32 are mounted on a common drive shaft 33. The idler roller shafts 31 are coaxially aligned and parallel to the common drive shaft 33. The driving nips formed by the mated idler rollers 30 and driven rollers 32 transport a sheet along the sheet transport path 28. Each of the opposing ends of the idler roller shafts 31 is removably mounted in openings 35 (see FIG. 3) of a cam follower 34 for rotation therein, so that each idler roller 30 is sandwiched between two cam followers.

In FIG. 3, a partially sectioned view of the cam follower 34 is shown as viewed along view line 3-3 in FIG. 2. Each cam follower has a shaft 36 at one end thereof that is substantially perpendicular to the cam follower to form a "T" therewith. The shaft 36 extends an equal distance from both sides of the cam follower. The other end of the cam follower has a cam surface 38. The opening 35 in each of the cam followers 34 hold the idler roller shafts and is located intermediate the shaft 36 and the cam surface 38. The shaft 36 of the cam follower 34 is pivotally mounted on a fixed frame member 37 (shown in dashed line) for pivoting of the cam follower relative thereto.

Referring also to FIG. 4 in which an exploded view of the cam follower is shown, a recess 39 in the cam follower 34 is located above opening 35 and is connected thereto. The recess 39 contains a slider 40 therein adapted to contact the shafts 31 of the idler rollers 30 mounted in the openings 35 of the cam followers and to slide in the recess 39 in a direction perpendicular to the idler roller shafts. The slider 40 in each cam follower has a recess 42 therein for housing a compression spring 44. One end of the compression spring 44 extends above the slider 40. A pin 46 holds the slider 40 in the recess 39 and concurrently holds the compression spring 44 in recess 42 of the slider. The pin 46 is positioned through an aperture 47 in the cam follower to lock both the slider 40 and compression spring 44 in place. The compression spring 44 that is held in place by the pin 46 applies a force on the slider 40 that in turn applies a force on the shafts 31 of the idler rollers 30 residing in the openings 35 of the cam follower. Thus, the compression spring 44 provides the normal force of the idler roller 30 to the driven roller 32 and currently allows for some movement of the idler roller 30 against the spring bias of the compression spring 44 for greater sheet transporting latitude.

A coiled tension spring 48 is fastened at one end around the same pin 46 that holds the slider 40 and compression spring 44 in place and the other end is attached to a fixed frame member 49. A cam 50 for each cam surface 38 on the cam followers 34 is mounted on a common cam shaft 52 that is parallel to the idler roller shafts 31 and driven roller shaft 33. Each cam 50 has a predetermined profile and is in contact with the cam surface 38 of the cam follower 34. Thus, rotation of the cam shaft 52 causes the cam follower 34 to pivot about its shaft 36 and in a direction against the urging of the tension spring 48. A reversible stepper motor 54, under the control of the controller 30, rotates the cam shaft 52 as required to position a specific contact location on the cam profile with the cam surface 38. The specific contact location of the cam profile against the cam surface of the cam follower adjusts the normal force of idler roller 30 against a sheet passing through the adjustable force driving nip assemblies 14. The drive shaft 33 of the driven rollers 32 is driven by a motor 55 and motor 55 is also under the control of the controller 30.

Figure 5:
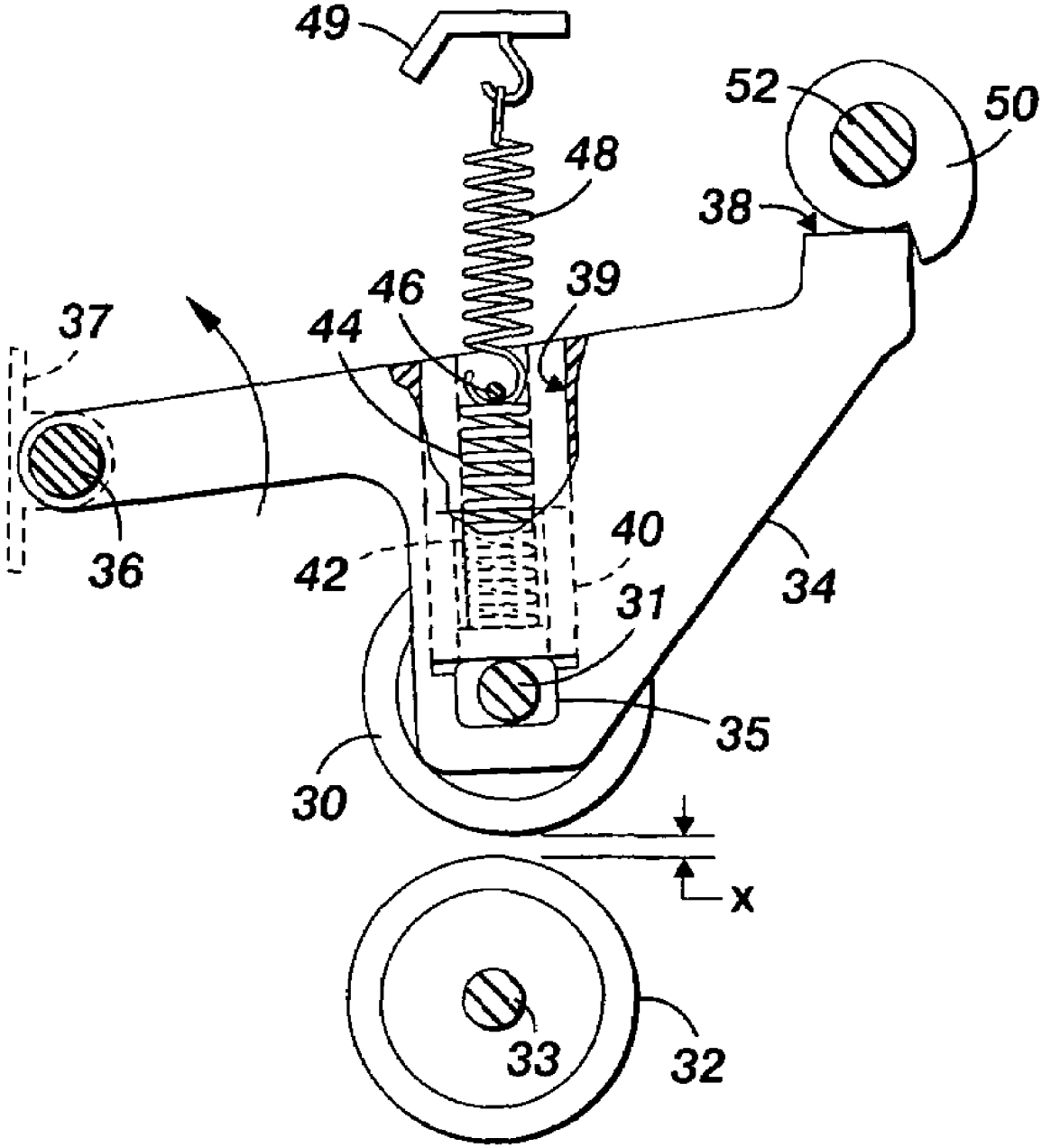
FIG. 5 is the same FIG. 3, except no normal force is being applied to the driven roller by the idler roller and they are separated.

In FIG. 3 the cam 50 is rotated to a profile position that generates the maximum normal force by the idler roller 39. In contrast, in FIG. 5, the cam 50 is rotated to a position that removes the normal force of the idler roller 30 and separates the idler roller from the driven roller 32, as indicated by the gap "X." Thus, rotation of the cam 50 in one direction increases the normal force of the idler roller and rotation in the other direction minimizes the normal force.

Figure 6:
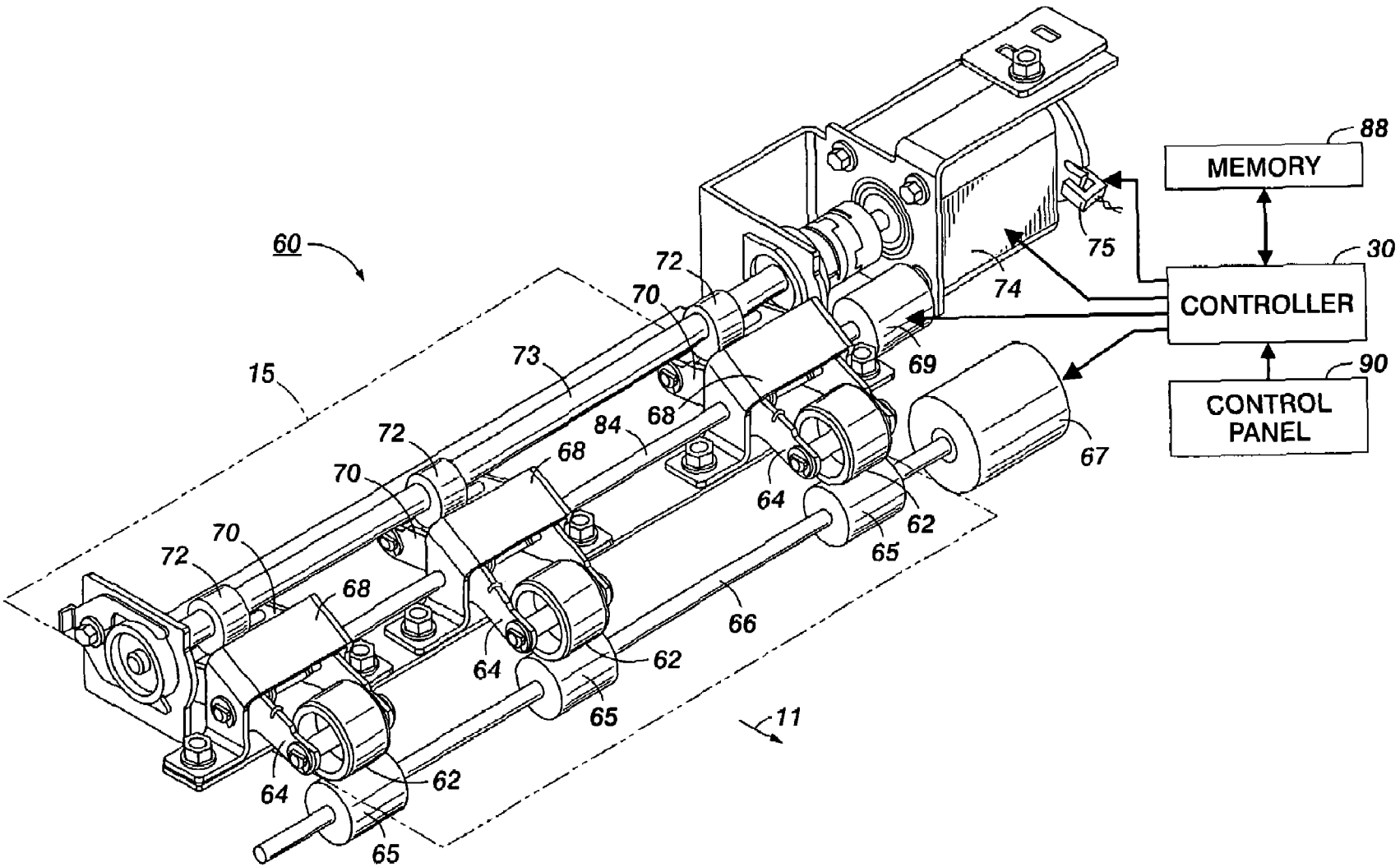
FIG. 6 is an isometric view of an alternate embodiment of the adjustable force driving nip assembly shown in FIG. 2.

An alternate embodiment 60 of the adjustable force driving nip assembly 14 is shown in FIG. 6 in an isometric view. In FIG. 6, the adjustable force driving nip assembly 60 includes two or more idler rollers 62 with three being shown in this embodiment. Each idler roller 62 is rotatably mounted on one end of a cam follower assembly 64. Each of the idler rollers 62 is mated with an associated driven roller 65 to form a driving nip therewith. The driven rollers 65 are mounted on a common drive shaft 66 that is driven by an electric motor 67. The electric motor 67 is controlled by controller 30. The cam follower assemblies 64 are pivotally mounted on a common pivot shaft 84 and located within spaced brackets 68 that are fixedly mounted to a frame member (not shown) of the document creating apparatus. The common pivot shaft 84 is rotatably mounted in the brackets 68 and is rotated by a stepper motor 69.

The stepper motor 69 is controlled by controller 30 in accordance with the sheet media parameters inputted into the control panel 90 of the document creating apparatus 10 by an end user. The pivot shaft 84 is parallel with the common drive shaft 66. The end of each cam follower assembly 64 opposite the one with the idler roller 62 has a cam roller 70 rotatably mounted thereon, as better seen in FIG. 7. An identical cam 72 for each cam roller 70 is fixedly mounted in a spaced relationship to each other on a common cam shaft 73 that is driven by a stepper motor 74 also under the control of the controller 30.

A home position indicator 75 is connected to the stepper motor 74 or a connecting shaft thereto and may be either a conventional notched disk optical sensor (as shown) or a typical rotary encoder. The home position indicator 75 may be rotated by the desired amount or angle to and from a home or reference position by the application of the desired number of step pulses from the controller 30. In the home position, the cams 72 are positioned to disengage the idler rollers 62 from the driven rollers 65. The cams 72 have a predetermined cam profile, so that rotation thereof by the cam shaft 73 causes the cam follower assemblies 64 to be pivoted by specific distances, thus providing the means to engage or disengage the idler rollers 62 from the driven rollers 65. In addition, the cams 72 may also be used to provide some adjustment of the normal force of the idler rollers to prevent marking thereon.

Referring also to FIG. 7, one cam follower assembly 64 is shown in an isometric view with the bracket 68 partially removed to better show the torsion spring 76 and torsion spring anchor 78. Each cam follower assembly 64 comprises a pair of parallel identical arms 79 that are rigidly fastened together by a cam roller shaft 80 at one end of the arms 79 and an idler roller shaft 82 at the opposite end. Each of the cam follower assemblies 64 in one driving nip assembly 60 is pivotally mounted on a common pivot shaft 84 and each cam follower assembly is located in a respective bracket 68. The brackets 68 are spaced along the pivot shaft 84. The pivot shaft 84 is rotatably mounted in the brackets 68 and has a torsion spring anchor 78 for each cam follower assembly 64. The respective torsion spring anchors 78 are centrally located within an associated bracket 68 and equally spaced between arms 79. The center of each torsion spring 76 is shaped around its respective torsion spring anchor 78 to lock it in place. Opposite side portions of each torsion spring 76 are wrapped around the pivot shaft several times at a location adjacent the arms 79, with the opposing ends of the torsion spring being bent to hook around and fasten to a respective arm 79 and hold them in place.

The common pivot shaft 84 is incrementally rotated by a reversible stepper motor 69 that is controlled by controller 30 in accordance with the sheet media parameters inputted into the control panel 90 of the document creating apparatus 10 by an end user. The rotation of the pivot shaft 84 causes an increase or decrease in the number of spring wraps around the pivot shaft because the torsion spring anchor 78 holds the middle of the torsion spring 76 and its opposing ends are connected to the arms 79 of the cam follower assembly 64.

Accordingly, the increase or decrease in the torsion spring wraps cause a corresponding increase or decrease in the torsional force applied to the idler roller 62, thereby adjusting the normal force of the idler rollers 62. This varying of the torsional force generated by the torsion spring 76 results in the varying of the normal force applied by the idler roller to the sheet 15 passing through the adjustable force driving nip assemblies 60.

In FIG. 8, a partially shown side view of the cam follower assembly 64 is depicted, showing the cam 72 in contact with the cam roller 70. Thus, rotation of the cam 72 about its predetermined profile, as indicated by the arrow 85, causes the cam roller 70 to rotate about its shaft 80 and move up or down in the direction of arrow 86. This movement of the cam roller 70 causes the cam follower assemblies 64 to pivot about their common pivot shaft 84 and engage or disengage the idler roller 62 (not shown in FIG. 8) from its respective driven roller 65 (see FIG. 6). Some normal force adjustment may also be available as the idler rollers are pivoted by cam 72 about the pivot shaft 84 against the urging of the torsion spring 76 (see FIG. 7) during separation and re-engagement of the idler rollers 62 with driven rollers 65.

Incremental locations around the profile of the cam 50, shown in FIGS. 2 and 3, or around the periphery of pivot shaft 84, shown in FIG. 6, represent various desired normal forces of the idler rollers 30 or 62. Data or algorithms that represent the various normal forces are stored in a look up table located in memory 88 that is associated with the controller 30. For each reproduction job to be performed by the document creating apparatus 10, an end user or operator inputs the job and sheet media information into the control panel 90, such as, for example, the sheet weight in grams per square meter ($g/m^2$), whether the sheets are coated or plain (not coated), as well as the number of sheets per set and number of sets. In response to the job and sheet parameter information inputted into the control panel 90, a microprocessor (not shown) in the document creating apparatus associated with the control panel 90 generates a specific value for each sheet in the job and directs that value to the controller 30. Each value received by the controller 30 represents a desired normal force to be applied by the idler rollers to the sheet being transported through the adjustable force driving nip assemblies 14 or 60. The controller compares the values received from the microprocessor with the values stored in the look up table in memory 88 that represent empirically determined algorithms also stored in memory 88. Each algorithm provides stepper motor instructions for the appropriate normal force that will not cause marking on the sheets being transported. The controller 30 selects the algorithm having the value matched by the value received from the microprocessor. The selected algorithm energizes the stepper motors 54 or 69 and rotates the cam shaft 52 or pivot shaft 84 the precise angular amount from the home position to achieve the desired normal force for the idler roller 30 or 62. A different normal force algorithm may be selected for each sheet in each set of a printing job by the document creating apparatus by the controller 30.

Accordingly, each sheet in each set of sheets in each job entered in the control panel 90 of the document creating apparatus 10 may be different. Therefore, each set of sheets in the job may have a different normal force for the idler rollers 30 or 62 of the adjustable force driving nip assemblies 14 or 60, respectively. A different algorithm may be used for each sheet to rotate automatically the cams 50 or pivot shaft 84 to the specific profile location thereon. In the embodiment of FIG. 2, cam 50 contacts the cam surface 38 and, in the alternate embodiment of FIG. 6, the pivot shaft 84 increases or decreases the number of spring wraps of the torsion spring 76 around the pivot shaft 84 to obtain the desired normal force for the idler rollers 30 or 62. This automatic changing of the normal force of the idler rollers prevents sheet marking even when the sheet media of each sheet in a set of sheets varies from thick to thin sheets. Accordingly, the exemplary embodiments of this application provide the ability of the document creating apparatus to handle a wider range of sheet media automatically without marking any of the sheets.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An adjustable force driving nip assembly for use in a sheet handling system of a document creating apparatus having a control panel for sheet media data entry by an end user, comprising:

a plurality of individual driving nips aligned and spaced transversely across a sheet transport path of said sheet handling system, each individual driving nip of said driving nip assembly having an idler roller mounted on a pivotable cam follower and mated against a driven roller, each of said idler rollers having an associated spring, said springs providing a force on said idler rollers to produce a normal force for said idler rollers that biases said idler rollers toward said driven rollers, wherein said cam follower further comprises a pair of identical cam follower members, each of said cam follower members having an opening intermediate opposite ends thereof with each of said opposing ends of said idler roller shaft being rotatably mounted in an opening in a respective one of said cam follower members, so that said idler rollers are located between respective pairs of cam follower members and wherein each of said cam follower members have a recess therein that is located above said cam follower opening and is in communication therewith, said recesses in said cam follower members each have a slider adapted to slide therein towards and away from said openings; and wherein each of said air of cam follower members have a compression spring to provide said force on said idler rollers rotatably mounted therein to produce said normal force for said idler rollers wherein a one of said compression springs is located in a respective recess in each of said sliders, said compression springs urging said sliders into contact with said idler roller shafts that reside in said openings of said cam follower members;

said driven rollers of said driving nip assembly being mounted on a common drive shaft having two ends;

a first stepper motor coupled to one end of said common drive shaft and adapted to interact concurrently with said cam followers upon actuation and thereby vary said force of said springs on said idler rollers to adjust said normal force thereof;

a memory for storing a plurality of algorithms, each algorithm being representative of a predetermined number of incremental steps from said stepper motor to achieve a desired normal force for said idler rollers; and a controller for selecting an algorithm from said memory in response to said sheet media data entered into said control panel by an end user and actuating said stepper motor in accordance with said selected algorithm to effect automatically an adjustment of said normal force of said idler rollers, thereby prevent marking of sheets transported by said sheet handling system.

2. The adjustable force driving nip assembly as claimed in claim 1, wherein each of said idler rollers have a shaft with opposing ends, said idler rollers being rotatable about said idler roller shafts, said idler roller shafts being coaxially aligned and parallel to said common drive shaft of said driven rollers.

3. The adjustable force driving nip assembly as claimed in claim 1, wherein each of said pair of cam follower members are pivotally mounted at one end with an opposite end thereof having a cam surface; and wherein a first cam for each cam surface on said cam follower members is mounted on a common first cam shaft, each of said first cams being in contact with a respective one of said cam surfaces, said common first cam shaft being rotated by said first stepper motor.

4. The adjustable force driving nip assembly as claimed in claim 3, wherein said pivotally mounted ends of said cam follower members are pivotally mounted on a fixed frame member of said sheet handling system for pivoting said cam follower members relative thereto.

5. The adjustable force driving nip assembly as claimed in claim 1, wherein each of said idler rollers have a shaft with opposing ends, said idler rollers being rotatable about said idler roller shaft, and each of said idler roller shafts being mounted on one end of each of said cam followers with each of said idler roller shafts being coaxially aligned and parallel to said common drive shaft of said driven rollers; and wherein each of said pivotable cam followers of said individual driving nips comprise a pair of parallel identical arms having opposing ends, said pair of arms being rigidly fastened together by a roller cam shaft at one end and by said idler roller shaft at the other end, so that each of said idler rollers are located between a respective pair of arms and at one end thereof; and wherein a roller cam is rotatably mounted on said roller cam shaft.

6. The adjustable force driving nip assembly as claimed in claim 5, wherein each of said pair of arms is pivotally mounted on a common pivot shaft, said common pivot shaft being positioned through a hole in each arm of said pair of arms, said holes in said pair of arms being positioned intermediate said opposing ends of said pair of arms with said common pivot shaft being parallel to said common drive shaft and idler roller shafts; and wherein a mounting bracket surrounds each pair of arms with said bracket being fixed to a frame member of said sheet handling system, and said first stepper motor being connected to one end of said pivot shaft for bi-directional rotation thereby.

7. The adjustable force driving nip assembly as claimed in claim 6, wherein each roller cam is mated with a second cam having a predetermined profile, and said second cams being fixed to a second common cam shaft that is driven by a second stepper motor to engage or disengage said idler rollers from said driven rollers.

8. The adjustable force driving nip assembly as claimed in claim 7, wherein said associated spring of each of said individual driving nips is a torsion spring; wherein a plurality of torsion spring anchors are fixed on said pivot shaft, one torsion spring anchor for each idler roller being positioned to be equally spaced between each arm of said pair of arms; and wherein a center of each of said torsion spring is shaped around a respective torsion spring anchor to lock each center of said torsion springs in place, each of said torsion springs having opposing equal portions wrapped around said pivot shaft, each of said opposing portions of said torsion spring having ends fastened to a respective one of said arms of each pair of arms, so that bi-directional rotation of said first stepper motor causes an increase or decrease in the number of wraps of said opposing spring portions of said torsion spring, thereby adjusting said normal force of said idler rollers.

9. The adjustable force driving nip assembly as claimed in claim 8, wherein a specific location on said common pivot shaft is a home position from which bi-directional rotation of said common pivot adjusts said normal force of said idler rollers by the increase or decrease in the number of wraps of said torsion spring on said common pivot shaft.

10. The adjustable force driving nip assembly as claimed in claim 9, wherein said control panel generates a specific value for each sheet based upon sheet media data inputted therein by an end user and directs said specific value to said controller, and in response to receipt of said specific value, said controller selects an algorithm from a set of algorithms stored in said memory matching said specific value and actuates said first stepper motor in accordance with said selected algorithm, thereby automatically adjusting said normal force of said idler rollers in order to prevent marking on sheets being transported through said sheet handling system.

11. An adjustable force driving nip assembly for use in a sheet handling system of a document creating apparatus having a control panel for sheet media data entry by an end user, comprising:

a plurality of individual driving nips aligned and spaced transversely across a sheet transport path of said sheet handling system, each individual driving nip of said driving nip assembly having an idler roller mounted on a pivotable cam follower and mated against a driven roller, each of said idler rollers having an associated spring, said springs providing a force on said idler rollers to produce a normal force for said idler rollers that biases said idler rollers toward said driven rollers, and wherein each of said idler rollers have a shaft with opposing ends, said idler rollers being rotatable about said idler roller shafts, said idler roller shafts being coaxially aligned and parallel to said common drive shaft of said driven rollers, said cam follower further comprising a pair of identical cam follower members, each of said cam follower members having an opening intermediate opposite ends thereof with each of said opposing ends of said idler roller shaft being rotatably mounted in an opening in a respective one of said cam follower members, so that said idler rollers are located between respective airs of cam follower members and wherein each of said cam follower members have a recess therein that is located above said cam follower opening and is in communication therewith said recesses in said cam follower members each have a slider adapted to slide therein towards and away from said openings; wherein each of said air of cam follower members have a compression spring to provide said force on said idler rollers rotatably mounted therein to produce said normal force for said idler rollers and wherein a one of said compression springs is located in a respective recess in each of said sliders, said compression springs urging said sliders into contact with said idler roller shafts that reside in said openings of said cam follower members;

said driven rollers of said driving nip assembly being mounted on a common drive shaft having two ends;

a first stepper motor coupled to one end of said common drive shaft and adapted to interact concurrently with said cam followers upon actuation and thereby vary said force of said springs on said idler rollers to adjust said normal force thereof;

a memory for storing a plurality of algorithms, each algorithm being representative of a predetermined number of incremental steps from said stepper motor to achieve a desired normal force for said idler rollers;

a controller for selecting an algorithm from said memory in response to said sheet media data entered into said control panel by an end user and actuating said stepper motor in accordance with said selected algorithm to effect automatically an adjustment of said normal force of said idler rollers, thereby prevent marking of sheets transported by said sheet handling system;

wherein each of said pair of cam follower members are pivotally mounted at one end with an opposite end thereof having a cam surface; and wherein a first cam for each cam surface on said cam follower members is mounted on a common first cam shaft, each of said first cams being in contact with a respective one of said cam surfaces, said common first cam shaft being rotated by said first stepper motor; and wherein said pivotally mounted ends of said cam follower members are pivotally mounted on a fixed frame member of said sheet handling system for pivoting said cam follower members relative thereto.

12. The adjustable force driving nip assembly as claimed in claim 11, wherein a pin positioned in an aperture in each of said cam follower members holds said sliders in place in each of said recesses in said cam follower members and concurrently holds said compression springs in said slider recesses.

13. The adjustable force driving nip assembly as claimed in claim 12, wherein a coiled tension spring is provided for each cam follower member and is fastened at one end around a respective one of said pins holding said sliders and said compression springs in place and the other end of said tension springs is attached to a fixed frame member of said sheet handling system.

14. The adjustable force driving nip assembly as claimed in claim 13, wherein said first cam has a predetermined profile, so that rotation of said first cam shaft by said first stepper motor repositions said cams on said cam surfaces and causes each of said pairs of cam follower members to pivot about said pivotally mounted ends and increase or decrease the spring force applied by said compression springs on said idler roller shafts through said sliders, whereby the specific contact location of said cam profile against its respective cam surface on said cam follower members adjusts said normal force of said idler rollers.

15. A method of automatically adjusting the normal force of idler rollers in an adjustable force driving nip assembly for use in a sheet handling system of a document creating apparatus having a control panel for sheet media data entry by an end user, comprising:

providing a plurality of individual driving nips aligned and spaced transversely across a sheet transport path of said sheet handling system, each of said driving nips having an idler roller mounted on a pair of cam followers at a location between said pair of cam followers and intermediate opposing ends of said sheet transport path and mated against a driven roller;

pivotally mounting said pairs of cam followers at one end thereof;

providing a cam surface on ends of said pairs of cam followers opposite said end that is pivotally mounted;

biasing at least one idler roller against said driven roller with a spring having a force that produces a normal force for said idler roller and urges said idler roller into contact with said driven roller, and using a compression spring to provide said force that produces said normal force for said idler rollers on each cam follower of said pairs of cam followers, said force by said compression spring being applied at a location on said cam followers between the opposing ends thereof;

contacting each cam surface on said pairs of cam followers with a cam, each cam being mounted on a common cam shaft and mounting said driven rollers on said common cam shaft;

driving said common cam shaft by an electric motor;

adapting a stepper motor to interact concurrently with said cam followers to vary said spring force of said springs and thereby adjust said normal force of said idler rollers by connecting said stepper motor to one end of said common cam shaft, so that bi-directional rotation of said cam shaft adjusts said force from said compression spring;

storing a plurality of algorithms in a memory, each algorithm being representative of a predetermined number of steps from said stepper motor to achieve a desired normal force for said idler rollers;

selecting an algorithm from said memory by a controller in response to sheet media data entered into said control panel by an end user; and actuating said stepper motor in accordance said selected algorithm to effect automatically an adjustment of said normal force of said idler rollers and prevent marking of sheets transported by said sheet handling system.

16. The method of automatically adjusting the normal force of idler rollers in an adjustable force driving nip assembly as claimed in claim 15, comprising:

providing a profile on said cams in which bi-directional rotation thereof from a home position causes said pair of cam followers to pivot about said ends that are pivotally mounted by precise amounts to obtain a desired adjustment of said force of said compression spring and thereby a desired adjustment of said normal force for said idler rollers.

17. The method of automatically adjusting the normal force of idler rollers in an adjustable force driving nip assembly as claimed in claim 15, comprising:

mounting each of said idler rollers on a pair of parallel arms and at a location between said pair of arms and at one end thereof;

mounting a cam roller on the other end of said pair of arms and at a location between said pair of arms;

pivotally mounting each of said pairs of arms on a pivot shaft at a location intermediate said idler rollers and said cam rollers;

using a torsion spring to provide said force that produces said normal force for said idler rollers, said torsion spring being wrapped around said pivot shaft and centrally fastened thereto at a location between said arms of each of said pair of arms;

mating each cam roller with a cam fixed on a common cam shaft rotated at one end thereof by a stepper motor;

rotating said common cam shaft to pivot each of said pairs of arms about said pivot shaft to engage or disengage said idler rollers from said driven rollers; and rotating said pivot shaft by a stepper motor connected to one end thereof to increase or decrease the number of wraps of said torsion spring around said pivot shaft, said number of wraps of said torsion spring determining the spring force thereof, so that said torsion spring force is increased or decreased by rotation of said pivot shaft, thereby adjusting said normal force for said idler rollers.

18. The method of automatically adjusting the normal force of idler rollers in an adjustable force driving nip assembly as claimed in claim 17, comprising:

providing an anchor on said pivot shaft for each torsion spring at a location intermediate of each pair of arms, said torsion springs being fastened to said pivot shaft by shaping a center of each torsion spring around respective anchors;

wrapping opposing end portions of each of said torsion springs around said pivot shaft at locations between respective pairs of arms; and fastening ends of each torsion spring to a respective arm of said pair of arms, so that bi-directional rotation of said pivot shaft by said stepper motor connected thereto will increase or decrease the number of wraps of said torsion spring around the pivot shaft, thereby increasing or decreasing the torsion spring force and thus the normal force for the idler rollers generated by said torsion spring.

* * * * *